US010245602B2

(12) United States Patent
Paal

(10) Patent No.: US 10,245,602 B2
(45) Date of Patent: Apr. 2, 2019

(54) ATOMIZER NOZZLE

(71) Applicant: SPRAYING SYSTEMS MANUFACTURING EUROPE GMBH, Schorndorf (DE)

(72) Inventor: Jochen Paal, Stuttgart (DE)

(73) Assignee: Spraying Systems Manufacturing Europe GmbH, Schorndorf (DE)

( * ) Notice: Subject to any disclaimer, the term of this patent is extended or adjusted under 35 U.S.C. 154(b) by 0 days.

(21) Appl. No.: 15/517,673

(22) PCT Filed: Oct. 9, 2014

(86) PCT No.: PCT/EP2014/071689
§ 371 (c)(1),
(2) Date: Apr. 7, 2017

(87) PCT Pub. No.: WO2016/055115
PCT Pub. Date: Apr. 14, 2016

(65) Prior Publication Data

US 2017/0304851 A1 Oct. 26, 2017

(51) Int. Cl.
*B05B 7/04* (2006.01)
*B05B 7/08* (2006.01)
*B05B 7/10* (2006.01)

(52) U.S. Cl.
CPC ..... *B05B 7/0491* (2013.01); *B05B 7/0466* (2013.01); *B05B 7/0483* (2013.01); *B05B 7/0892* (2013.01); *B05B 7/10* (2013.01)

(58) Field of Classification Search
CPC ... B05B 7/0441; B05B 7/0466; B05B 7/0483; B05B 7/0491; B05B 7/0892; B05B 7/10
USPC ..... 239/403, 428.5, 124, 125
See application file for complete search history.

(56) References Cited

U.S. PATENT DOCUMENTS 3,790,086 A * 2/1974 Masai ..... B05B 7/0416 239/406
7,704,420 B2 * 4/2010 Stevens ..... B01J 2/16 264/12

FOREIGN PATENT DOCUMENTS

CN 86107989 A 9/1987
CN 1846096 A 10/2006
CN 101242908 A 8/2008
CN 102176977 A 9/2011
(Continued)

*Primary Examiner* — Alexander M Valvis
(74) *Attorney, Agent, or Firm* — Leydig, Voit & Mayer, Ltd.

(57) ABSTRACT

The invention relates to an atomizer nozzle (10) with a liquid channel (19) which communicates downstream with an annular mixing chamber (26). A liquid (F) is supplied to the liquid channel (19) via a liquid connection (12). The atomizer nozzle (10) additionally has a gas connection (13) which is connected to a gas line system (28). Pressurized gas (L) is conducted to an outer injection channel (29) and an inner injection channel (34) via the gas line system. Each of the two injection channels (29, 34) opens into the annular mixing chamber (26) at a respective injection point (30, 35). The outer injection point (30) is provided on a radially outer mixing chamber wall, and the inner injection point (35) is provided on a radially inner mixing chamber wall. The inflowing liquid can thus be finely atomized using little pressurized gas (L) in the annular mixing chamber (26) and dispensed downstream of the annular mixing chamber via at least one outlet opening (40) in the form of a spray jet (S).

10 Claims, 3 Drawing Sheets

(56) References Cited

FOREIGN PATENT DOCUMENTS

| | | | | | |
|---|---|---|---|---|---|
| CN | 102679398 | A | | 9/2012 | |
| CN | 102858466 | A | | 1/2013 | |
| EP | 0458685 | A1 | | 11/1991 | |
| EP | 0458685 | B1 | * | 7/1994 | ..... B05B 7/04 |
| WO | 2008/032088 | A1 | | 3/2008 | |

* cited by examiner

ATOMIZER NOZZLE

FIELD OF THE INVENTION

The invention relates to an atomizer nozzle that can be used on spray devices for atomizing liquids. The atomizer nozzle can be arranged on mobile or stationary spray devices.

BACKGROUND OF THE INVENTION

Atomizer nozzles are used for the fine atomization of a liquid, for example water or a liquid mixture, that may also contain additives such as cleaning agents or the like, with the liquid being supplied to an atomizer nozzle. For reasons of simplicity, reference is made hereinafter to a liquid, in which case this shall also comprise liquid mixtures. Pressurized gas is used for the atomization of liquid into fine liquid particles, said gas being admixed to the liquid in a mixing chamber. The liquid that is atomized with the aid of the pressurized gas is discharged as an atomized spray jet to at least one outlet opening of the atomizer nozzle.

The atomizer nozzle can be used in various fields of application, for example for spraying fertilizers, pesticides or fungicides in agriculture or for moistening or cooling objects in industrial production, for spraying water and/or cleaning agents, or for facilitating the evaporation of liquids by atomization in the chemical industry. In principle, the atomizer nozzle can be used wherever a very fine atomization of a liquid is required.

An atomizer nozzle has been known, for example, from publication EP 0 714 706 B1. The atomizer nozzle has a liquid connection, as well as a gas connection. The liquid connection is fluidically connected to a liquid channel that extends coaxially along a nozzle axis and terminates in a mixing chamber. The liquid flow flows as a jet along the nozzle axis into the mixing chamber. Several injection channels terminate in the mixing chamber radially with respect to the nozzle axis, said injection channels being fluidically connected to the gas connection. In the mixing chamber, the axial liquid flow is atomized over the gas flowing transversely thereto and dispensed downstream along the nozzle axis through an outlet opening toward the outside.

OBJECTS AND SUMMARY OF THE INVENTION

It is an object of the invention to provide an atomizing nozzle effective for improved and more efficient atomization of liquid with the aid of gas. The subject atomizer nozzle comprises a liquid connection for supplying a liquid. The liquid may be a single liquid or a liquid mixture. The liquid connection is connected to a liquid channel through which the supplied liquid flows and which terminates downstream in an annular mixing chamber. The annular mixing chamber encloses a nozzle axis of the atomizer nozzle in the form of a ring and is arranged coaxially with respect to the nozzle axis.

An end section that terminates directly in the annular mixing chamber becomes wider toward the annular mixing chamber. The outside diameter of the end section becomes larger toward the annular mixing chamber. Preferably, a central part may be arranged in this end section. The nozzle axis may preferably extend through the central part. With the aid of a means of the atomizer nozzle that comprises, for example, the central part and/or a swirl-generating means, a flow layer is formed of the liquid flowing through the end section, said flow layer diverging away from the nozzle axis and, preferably, being completely closed in the form of a ring in circumferential direction around the nozzle axis. The flow layer is oriented obliquely away from the nozzle axis. Preferably, a flow layer having the form of a hollow cone or a hollow truncated cone is formed, said flow layer potentially also being referred to as a liquid film.

The annular mixing chamber adjoins the end section of the liquid channel. The liquid of the flow layer flows out of the end section into the annular mixing chamber.

Via a gas connection, pressurized gas is supplied to a gas line system of the atomizer nozzle. In principle, it is possible to use any gas or gas mixture as the pressurized gas or gas mixture, at any temperature and/or at any pressure, irrespective of the saturation vapor pressure and/or the critical temperature of the gas or gas mixture. For example, pressurized air and/or nitrogen and/or hydrogen may be used as the pressurized gas. In a few applications, it is also possible to use steam as the pressurized gas, for example, water vapor.

The gas line system comprises at least one outer injection channel and at least one inner injection channel. Via the injection channels, pressurized gas is injected into the annular mixing chamber. The outer injection channel terminates at an outer injection point, and the inner injection channel terminates at an inner injection point in the annular mixing chamber. The inner injection point is enclosed by the annular mixing chamber that extends coaxially around the nozzle axis. Viewed in radial direction with respect to the nozzle axis, the outer injection point is located on the radially outer side of the annular mixing chamber, and the inner injection point is located on the radially inner side of the annular mixing chamber.

Consequently, the gas flows from the outside and from the inside into the annular mixing chamber and impinges there on the flow layer. The pressurized gas is directed radially from the outside and radially from the inside against the flow layer having the form of a hollow truncated cone. By producing a film-like liquid layer and by injecting pressurized gas via the two injection points into the annular mixing chamber from opposite sides, a clearly improved atomization of the liquid is achieved. It is possible to generate very small liquid particles that can be dispensed downstream through the atomizer nozzle. Furthermore, by injecting the pressurized gas into the relatively thin flow layer having the form of a truncated cone, it is possible to keep low the pressurized gas consumption required for atomization. Consequently, the pressurized gas consumption decreases due to the use of the atomizer nozzle, thus reducing the operating costs of a spray device equipped with the atomizer nozzle.

Preferably, the outer injection point and the inner injection point are arranged offset relative to each other in the direction of an extension of the annular mixing chamber. The extension direction of the annular mixing chamber is understood to mean the course of the center plane through the annular mixing chamber—beginning at the end section of the liquid channel up to the outer end of the annular mixing chamber, upstream of the at least one outlet opening. Thus, the extension direction of the annular mixing chamber refers not to its course in circumferential direction about the nozzle axis but at a right angle thereto along the center plane. The outer and the inner injection points may also be arranged opposite each other in the extension direction of the annular mixing chamber.

In one exemplary embodiment, the inner injection point is arranged in the extension direction of the annular mixing chamber upstream relative to the outer injection point. The pressurized gas supplied via the inner injection point imparts the liquid flow with a radial component or a flow component toward the outer injection point. There, pressurized gas is also supplied, in which case—due to the excitation or the radially outward-directed flow component—a further improved atomization into small liquid particles is generated. Because of the gas flows coming in from the different directions at the two injection points, it is additionally possible for a shearing effect to act on the flow layer, which is the case in particular when the outer and the inner injection points are arranged offset—but close to each other—in the extension direction of the annular mixing chamber. A spatially close arrangement of the two injection points is understood to mean that the pressurized gas flowing in from one of the two injection points impinges at least partially directly on the respectively other injection point or on a wall section that is directly adjacent to the other injection point.

In a preferred exemplary embodiment, the inner injection point specifies a main flow direction that intersects the center plane of the annular mixing chamber at a first angle. Correspondingly, the outer injection point may specify a main flow direction that intersects the center plane of the annular mixing chamber at a second angle. Preferably, the dimension of the second angle is smaller than the dimension of the first angle. For example, the first angle may be in the range of 45° to 90°, preferably between 60° and 90°. The second angle is smaller than 70°, for example, and preferably smaller than 45°.

In a preferred exemplary embodiment the gas line system fluidically connects each the inner injection channel and the outer injection channel to the gas connection. Thus, the pressurized gas available at the gas connection flows into both injection channels. In so doing, the gas line system is configured in such a manner that the gas volume flow that flows via the outer injection channel into the annular mixing chamber is greater than the gas volume flow that flows via the inner injection channel into the annular mixing chamber. The gas volume flow flowing via the outer injection channel into the annular mixing chamber can amount to more than 50%, and preferably up to 80%, of the total gas volume flow that flows—via both injection channels—into the annular mixing chamber. Due to this apportioning, it is possible to achieve good atomization at further reduced pressurized gas consumption. Depending on existing conditions and requirements, gas volume flow percentages of less than 50% or more than 80% may also be selected.

There exists at least one outlet opening downstream of the annular mixing chamber. A spray jet exits from the at least one outlet opening, said jet containing the liquid that has been atomized by the gas. Preferably, several outlet openings are distributed in circumferential direction around the nozzle axis and, in accordance with the example, distributed in the same circumferential section. Preferably, each of the outlet openings has a rotation-symmetrical configuration and may be cylindrical and/or widening and/or configured as a Laval nozzle.

A further improvement of the atomization of the liquid in one exemplary embodiment is achieved in that the annular mixing chamber is curved one or more times between the injection points and the at least one outlet opening in the direction of the nozzle axis. In this region, the annular mixing chamber—viewed along the nozzle axis—may curve toward the nozzle axis and/or away from the nozzle axis.

In a preferred exemplary embodiment the annular mixing chamber is configured so as to be rotation-symmetrical relative to the nozzle axis.

In a preferred embodiment, the atomizing nozzle may comprise a swirl-generating means. The swirl-generating means is disposed to impart the liquid flowing into the liquid channel and, in particular, into the end section of the liquid channel with a swirl. The swirl-generating means may be configured such that an inflow mouth for supplying the liquid into the liquid channel is radially offset and obliquely oriented relative to the nozzle axis. As a result of this, already the liquid flowing into the liquid channel will flow helically with a swirl along the liquid channel.

Alternatively or additionally, the swirl-generating means may comprise a swirl generator that is arranged in the liquid channel, in particular, upstream of the end section of the liquid channel. The liquid flows to the swirl generator which imparts a swirling motion to the liquid flow. This can be effected by inclined and/or helical guide surfaces and/or guide channels and/or by a rotor of the swirl generator, e.g., an impeller. Basically, all known swirl-generating means can be used alone or in combination.

It is advantageous if the swirl generator is arranged in a swirl-generating section of the liquid channel that adjoins the end section of the liquid channel upstream. The swirl-generating section may be located, e.g., upstream of and in the immediate vicinity of a transition section of the liquid channel that leads to the end section and has a cross-section or diameter that tapers toward the end section. In so doing, the flow cross-section in the swirl-generating section available for the liquid may essentially be constant in flow direction.

Furthermore, it is advantageous if the gas line system comprises a central channel that extends along the nozzle axis in the central part. The central channel terminates in the liquid channel. Pressurized gas may flow in—essentially against the axial flow direction component of the liquid—out of the central channel directly upstream of the end section of the liquid channel and contribute there to an improved formation of the flow layer having the form of a hollow truncated cone.

In one exemplary embodiment, the atomizer nozzle has a nozzle body in which the liquid channel and the annular mixing chamber are formed. Preferably, the nozzle body is made as an integral part of material without a seam or joint. Preferably, said nozzle can be produced by so-called additive manufacturing processes such as, for example, the 3D printing process. Furthermore, it is preferred if all the liquid-conveying lines and channels are formed in the nozzle body. Preferably, the central part is an integral part of this nozzle body.

Other objects and advantages of the invention will become apparent upon reading the following detailed description and upon reference to the drawings.

Figure 1:
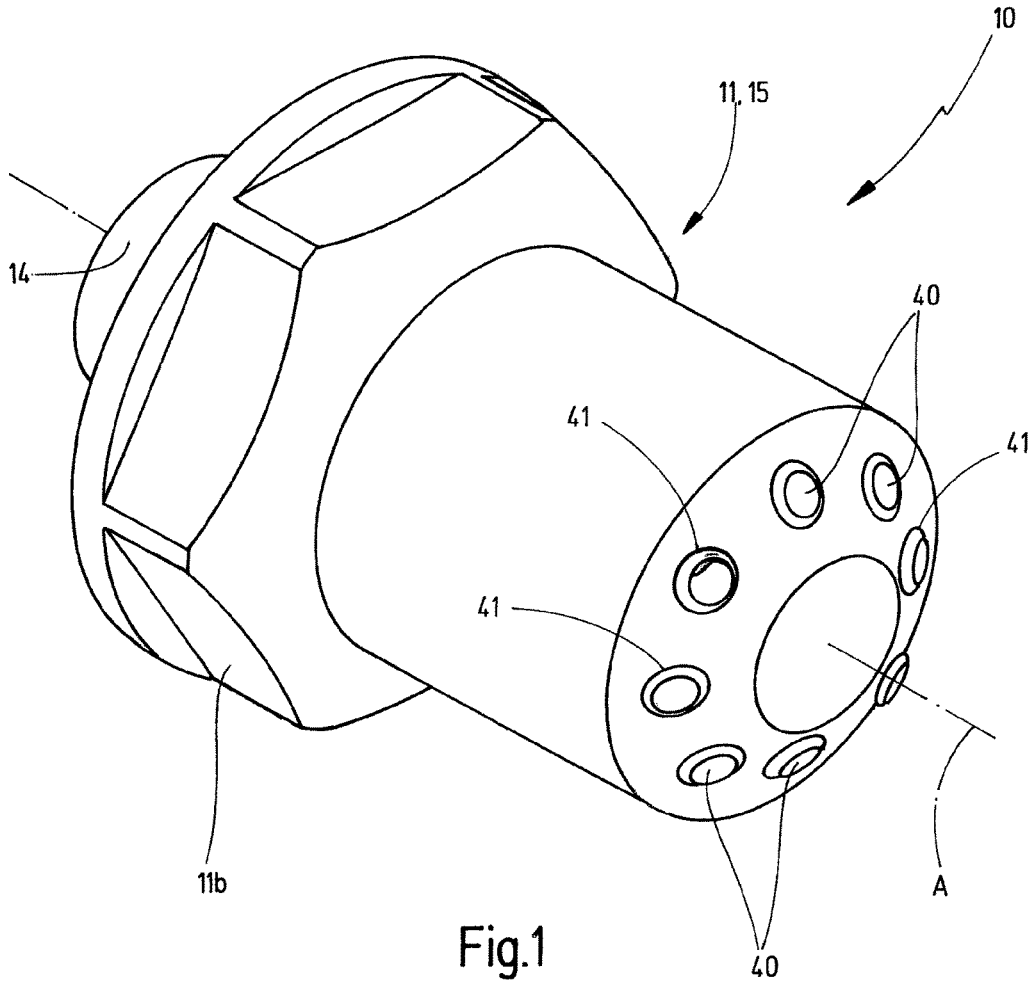
FIG. 1 is a perspective view of an exemplary embodiment of an atomizer nozzle in accordance with the invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE PREFERRED EMBODIMENTS

Figure 3:
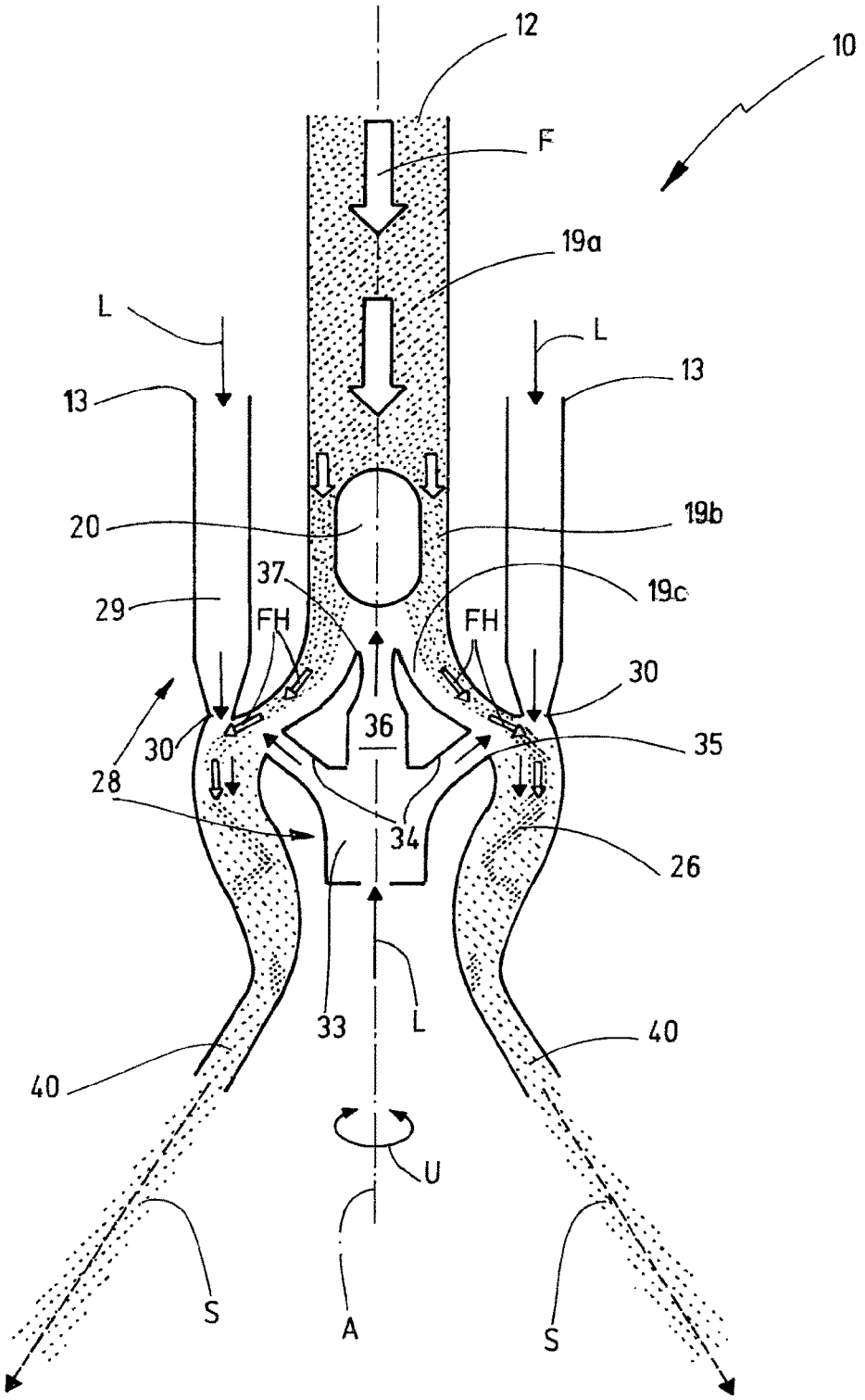
FIG. 3 is a schematic depiction of the inventive atomizer nozzle.

Referring more particularly to the drawings, there is shown an atomizer nozzle 10 in accordance with the invention. The atomizer nozzle 10, which may be used in a mobile or stationary spray device, is effective for atomizing a supplied liquid F with the use of pressurized gas L and to dispense the finely atomized liquid particles as a spray jet S or as an atomized spray. In FIG. 3 the flowing liquid F is schematically illustrated by block arrows, and the pressurized gas L is schematically illustrated by simple arrows. The dot density schematically illustrates the fine atomization of the liquid F in FIG. 3, in which the lower dot density represents a finer atomization.

The atomizer nozzle 10 comprises a nozzle housing 11. Provided on the nozzle housing, there are a liquid connection 12 for the supply of liquid F and a gas connection 13 for the supply of pressurized gas L. The liquid connection 12 is arranged on a hollow cylindrical connection fitting 14 of the nozzle housing 11. The connection fitting 14 is arranged coaxially relative to a nozzle axis A. The gas connection 13 in this case is arranged coaxially relative to the nozzle axis A so as to form a ring around the connection fitting 14. The number, arrangement, and orientation of the gas connection (s) 13 or the liquid connection(s) 12 may vary depending on the spray device on which the atomizer nozzle 10 is used.

In the exemplary embodiment shown here, the nozzle housing 11 comprises a housing part 11*a* having an approximately cylindrical contour, from which extends the connection fitting 14 of the nozzle housing 11. The housing part 11*a* is arranged coaxially relative to the nozzle axis A. The gas connection 13 is arranged coaxially around the connection fitting 14 in a face wall of the housing part 11*a*. A tool contact section 11*b* may be provided on the housing part 11*a* having one or more contact surfaces for a tool—for example, flats for rotating the atomizer nozzle 10 in circumferential direction U about the nozzle axis A and for mechanically and fluidically connecting the atomizer nozzle to the spray device when the atomizer nozzle is mounted to a spray device.

In accordance with the example, the nozzle housing 11 is made as a one-piece integral nozzle body 15 and can be manufactured, for example, as a 3D print or by means of another additive manufacturing process. The nozzle body 15 is free of seams and joints and is made of a uniform material. The nozzle body 15 further includes, as will become apparent, a flow directing structure (19*c*, 20, 25) that forms a widened flow layer FH of liquid F obliquely away from the nozzle axis A with a swirling movement.

To that end, the liquid connection 12 is fluidically connected to a liquid channel 19. A first section 19*a* of the liquid channel 19 adjoining the liquid connection 12 has a cylindrical form and extends coaxially relative to the nozzle axis A. Directly adjoining the first section 19*a* there is a swirl-generating section 19*b* of the liquid channel 19. Arranged in this swirl-generating section 19*b* there is arranged a swirl generator 20 that imparts the liquid F flowing from the first section 19*a* into the swirl-generating section 19*b* with a swirl. By imparting the swirl, the liquid F no longer flows only axially along the liquid channel 19—in the, or downstream of the, swirl-generating section 19*b*—but follows a jet course having the form of a hollow cone or, optionally, of a spiral or helix.

In the exemplary embodiment, the swirl generator 20 is a swirl body 21 arranged coaxially relative to the nozzle axis A in the swirl-generating section 19*b*. The swirl body 21 may have guide surfaces defined by guide channels to impart the liquid F with a swirl. It is also possible to use a swirl generator 20 with an impeller.

Basically, one or more suitable swirl-generating means may be used to impart the liquid with a swirl when flowing into the liquid channel 19 or during its flow in the liquid channel 19. It is also possible to use flow effects such as, for example the Coanda effect, to impart a swirl. Furthermore, it is possible to configure the inflow of the liquid F into the liquid channel 19 radially offset relative to the nozzle axis A, tangentially relative to a channel wall 22 of the liquid channel 19 and obliquely inclined relative to the nozzle axis A, so that—already due to this—a swirl-imparted liquid flow is achieved.

Another alternative is to arrange—instead of the swirl generator 20—an impact body in the liquid channel 19 that is suitable or essentially, e.g., shaped like a plate, so that when a liquid F impinges on the impact body, a thin, essentially plate-shaped liquid layer is formed, said layer also being referred to as the impact jet.

In the exemplary embodiment described here, the generation of a swirl in the swirl-generating section 19*b* is supported in that the channel cross-section of the swirl-generating section 19*b* or of a transition section directly following the swirl-generating section 19*b* and not specifically described here is reduced downstream in flow direction. This is accomplished in that the diameter of the swirl-generating section 19*b* or the transition section decreases starting from the first section 19*a*. Preferably, the swirl generation is completed just upstream of the transition section.

In a modified exemplary embodiment the diameter of the liquid channel 19 in the swirl-generating section 19*b* may constant and the tapering transition section may be omitted, as is shown, for example, schematically in FIG. 3.

Optionally, via the transition section, an end section 19*c* of the liquid channel 19 adjoins the swirl-generating section 19*b*. In the end section 19*c* of the liquid channel 19, the diameter of the channel wall 22 increases away from the swirl-generating section 19*b*. The liquid flowing along the channel wall 22—starting from the smallest channel wall diameter at the transition point between the swirl-generating section 19*b* and the end section 19*c*—tends to continue to flow along the channel wall 22. As a result of this, a flow layer FH of the liquid F is formed in the end section, said flow layer having the form of a hollow truncated cone. The flow layer FH is formed coaxially relative to the nozzle axis A in the atomizer nozzle 10. The flow layer FH is illustrated schematically in FIG. 3 by the block arrows and the dots in the end section 19*c*.

In order to further support the formation of the flow layer FH having the form of a hollow truncated cone, a central liquid directing part 25 is arranged in the end section 19*c* of the liquid channel, the diameter of said end section widening toward an annular mixing chamber 26 in which terminates the liquid channel 19. In accordance with the example, the annular mixing chamber 26 directly adjoins the end section 19*c* of the liquid channel 19.

The nozzle axis A extends centrally through the central part 25. Due to the arrangement of the central part 25 and the widening channel cross-section of the end section 19*c*, the end section 19*c* is configured as a channel having the form of a truncated cone coaxially relative to the nozzle axis A, closed in the form of a ring in circumferential direction U around the nozzle axis A.

The channel wall 22 of the liquid channel 19 extends in a curved manner in the swirl-generating section 19*b* and the end section 19*c* along the nozzle axis A. As a result of this, the channel cross-section is further reduced in the swirl-generating section 19*b* and is enlarged again in the end section 19*c*. Adapted thereto, the outside surface 27 of the central part 25 is also curved along the nozzle axis A and, in accordance with the example, curved concavely. The outside surface 27 of the central part 25 is located opposite the channel wall 22 and is preferably adapted to the course of the channel wall in such a manner that the radial wall distance between the outside surface 27 of the central part 25 to the outside inner wall of the end section 19*c* extending perpendicularly to the nozzle axis A remains essentially constant, in which case the annular cross-sectional area of the flow increases in downstream direction with increasing distance from the nozzle axis A.

Consequently, upstream of the annular mixing chamber 26 in the atomizer nozzle 10, a flow layer FH having the form of a hollow truncated cone is generated, said flow layer flowing into the annular mixing chamber 26. To do so, a swirl-generating means and/or the widening end section 19*c* with the central part 25 arranged therein can be used. In accordance with the example, both measures are implemented together.

Pressurized gas L is supplied to the annular mixing chamber 26 adjoining the end section 19*c* in order to atomize the liquid F into small liquid particles. To do so, the gas connection 13 is connected to a gas line system 28 of the atomizer nozzle 10. The gas line system 28 comprises gas hoses that are arranged outside the nozzle housing 11, wherein—as in the preferred exemplary embodiment shown here—preferably only gas channels are used that are arranged or configured in the nozzle housing 11 and, in accordance with the example, in the housing part 11*a*. Referring to the exemplary embodiment, all gas channels of the gas line system 28 are made in the course of the manufacture of the nozzle body 15.

The gas line system 28 comprises an outer injection channel 29 that extends around the nozzle axis A in circumferential direction U in the form of a ring around at least one section of the liquid channel 19 and that terminates at an outer injection point 30 in the annular mixing chamber 26. The outer injection point 30 is configured as a gap having the form of a circular ring and is arranged coaxially relative to the nozzle axis A.

Radially outside, opposite the annular mixing chamber 26 and, in accordance with the example, coaxially relative to the annular mixing chamber 26, there is arranged—in the exemplary embodiment—an annular connecting channel 31 of the gas line system 28 in the nozzle housing 11, said connecting channel 31 being fluidically connected—via one or more passage openings 32—to a central gas channel 33 of the gas line system 28. The central gas channel 33 extends along the nozzle axis A and is enclosed by the annular mixing chamber 26 in circumferential direction U. A part of the pressurized gas L that is supplied to the central gas channel 33 terminates in an inner injection channel 34 on the radially inner side of the annular mixing chamber 26. The inner injection channel 34 may be formed by a section of the central gas channel 33 or branch off the central gas channel 33 separated by dividing walls. The inner injection channel 34 terminates at an inner injection point 35 in the annular mixing chamber 26. The inner injection point 35 is configured as a circular ring gap that is preferably closed in the circumferential direction U around the nozzle axis A, and is as continuous as possible.

Next to the inner injection channel 34, there is fluidically connected to the central gas channel 33 a central channel 36 that may branch off the central gas channel 33 or be formed by a section of the central gas channel 33. The central channel 36 terminates upstream of the end section 19*c* in the liquid channel 19*a*. The mouth 37 of the central channel 36 is arranged coaxially relative to the nozzle axis A and is oriented away from the end section 19*c* or the annular mixing chamber 26 in the direction of the nozzle axis A. The pressurized gas L flowing out at that location flows approximately against the liquid F and supports the formation of the flow layer FH in the end section 19*c* of the liquid channel 19.

At the end of the atomizer nozzle 10 where at least one spray jet S is being dispensed, there is at least one outlet opening 40. In the preferred exemplary embodiment shown here in FIGS. 1 and 2, the atomizer nozzle 10 has several outlet openings 40, for example 8, that are distributed around the nozzle axis A in the circumferential direction U. The at least one outlet opening 40 may be configured as a cylindrical bore, as a slit or, preferably, as a Laval nozzle. In accordance with the example, the at least one outlet opening 40 has a cross-section that widens conically in the flow direction. The longitudinal axis of each outlet opening 40 is inclined relative to the nozzle axis A. The angle of inclination of the bore axis of the outlet opening 40 relative to the nozzle axis A is preferably in the range between 10° and 30°. As a result of the plurality of outlet openings 40, respectively one spray jet S is generated, said spray jet being directed away from the nozzle axis A (FIGS. 1 and 3).

The outlet openings 40 are provided in tube pieces 41 that fluidically communicate with the annular mixing chamber 26. Between the tube pieces 41, passage openings 32 are formed in that—in the circumferential direction U—directly adjacent tube pieces 41 are arranged at a distance from each other. As a result of this, a fluidic connection between the connecting channel 31 and the central gas channel 33 is formed between the tube pieces 41.

Between the connecting channel 31 and the outer injection channel 29, there is a dividing wall 45 that conducts the gas flow in the outer injection channel 29 toward the outer injection point 30. At least one communication opening 46 is provided in the dividing wall 45 in the direction of flow of the pressurized gas L at a distance from the outer injection point 30, through which communication opening the pressurized gas L may flow out of the gas connection 13 into the connecting channel 31. Consequently, the outer injection channel 29, as well as the inner injection channel 34, are supplied with pressurized gas L via the gas connection 13.

Depending on requirements, the volume flows in the connecting channel 31 up to the central gas channel 33 and the inner injection point 35 are defined via the communication opening 46, on the one hand, and by the outer injection channel 29 and the outer injection point 30, on the other hand. In preferred embodiments, the ratio of the cross-sectional area of the communications opening 46 to that of the outer injection point 30, for example, is in the range of approximately 20% to 40%, preferably at approximately 30%.

In so doing, the cross-sections in the gas line system 28 may be selected as needed in such a manner that—via the injection channel 29 and the outer injection point 30—a larger gas volume flow flows into the annular mixing chamber 26 than via the inner injection channel 34 or the inner injection point 35. In accordance with the example the surface ratio between the outer injection point 30 relative to the inner injection point 35 is specified at a ratio of 1.5:1 to 2.5:1. In the preferred exemplary embodiment the surface ratio is approximately 2:1. Then, in accordance with the example, at least approximately two thirds of the gas flowing into the annular mixing chamber 26 may flow in via the outer injection point 30.

In the exemplary embodiment, the surface ratio between the inner injection point 35 and the mouth 37 of the central channel 36 is approximately 1:10 to 1:15.

Figure 2:
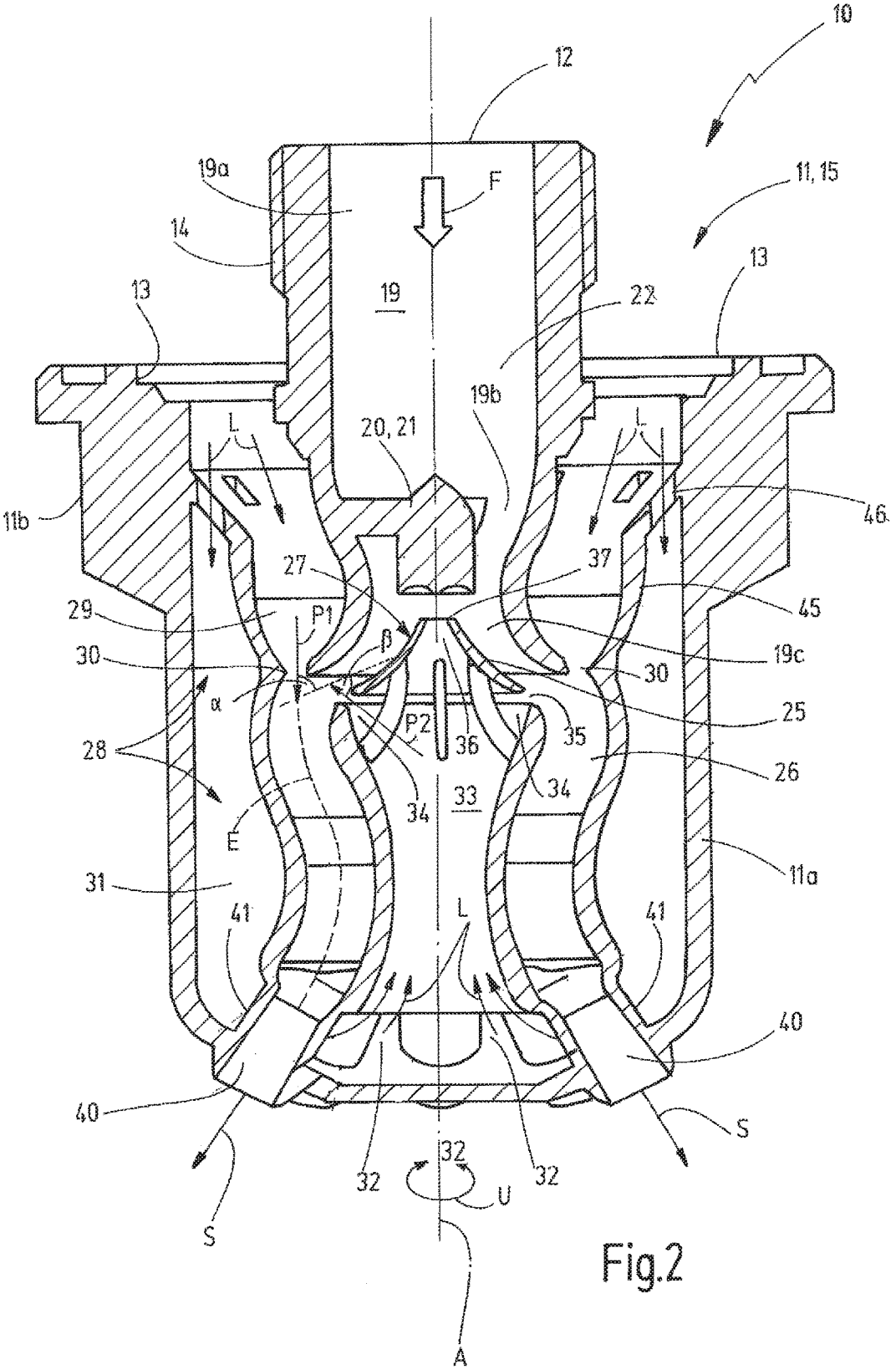
FIG. 2 is a longitudinal section of the atomizer nozzle depicted in FIG. 1 taken along the central axis of the nozzle.

As illustrated by FIGS. 2 and 3, the liquid F in the annular mixing chamber 26 is supplied with pressurized gas L at both injection points 30, 35. FIG. 2 shows—schematically—a center plane E of the annular mixing chamber 26 that corresponds essentially also to the center of the liquid jet in the annular mixing chamber 26. The central liquid jet entering from the end section 19*c* into the annular mixing chamber 26 is indicated by a dotted line. In the extension direction of the annular mixing chamber 26 along the center plane E through the annular mixing chamber 26, the two injection points 30, 35 are arranged so as to be offset relative to each other. In accordance with the example, the pressurized gas L that flows out of the inner injection point 35 impinges initially on the liquid F or the flow layer FH that passes by, while the pressurized gas L from the outer injection point 30 flows farther downstream into the annular mixing chamber 26. In FIG. 2, the first arrow schematically shows the first main flow direction P1 out of the outer injection channel 29 into the annular mixing chamber 26. This first main outflow direction P1 that, here, for example, extends approximately parallel to the nozzle axis A intersects the central liquid jet at a first angle α. Accordingly, the second arrow indicates a second main outflow direction P2 for the pressurized gas L out of the inner injection channel 34 that is arranged at an acute angle relative to the axis nozzle A and subtends a second angle β with the central liquid jet. In accordance with the example, the second angle β is larger than the first angle α. The first angle α is, in particular, smaller than 45°, while the second angle β is between 70° and 90°.

The atomizer nozzle 10 according to the present invention operates as follows:

A liquid F flows through the liquid channel 19. Via a swirl-generating means—in accordance with the example the swirl generator 20—the liquid flow in the swirl-generating section 19*b* is imparted with a swirl. As a result of this and/or as a result of the pressurized gas flowing out of the central channel 26 via the mouth 27 through the central part 25, and/or as a result of the diameter of the end section 19*c* of the liquid channel 19 widening toward the annular mixing chamber 26, a flow layer FH having the form of a hollow truncated cone is generated, said flow layer flowing into the annular mixing chamber 26.

In the annular mixing chamber 26, initially the pressurized gas L impinges at the inner injection point 35 on the flow layer FH and affects the flow direction of the latter in that it imparts the liquid flow in the flow layer FH with an additional transverse component away from the nozzle axis A toward the radially outside side of the annular mixing chamber 26. Somewhat downstream, the pressurized gas L is supplied at the outer injection point 30. As a result of the fact that the liquid flow was already excited upstream at the inner injection point 35, the inflow of the pressurized gas L from the direction of the outer side of the annular mixing chamber achieves a very fine atomization of the liquid. Thus, the pressurized gas L flowing into the annular mixing chamber from different sides generates a shearing effect, so to speak.

In the continued course of the annular mixing chamber 26 downstream of the two injection points 30, 35, it is possible—due to one or more curvatures in extension of the annular mixing chamber 26 toward the nozzle axis A and/or away from the nozzle axis A—to achieve another atomization and uniform distribution of the liquid particles in the liquid/gas mixture that, subsequently, is dispensed through the outlet openings 40 in the form of spray jets S. In accordance with the example, the annular mixing chamber 26 curves downstream of the two injection points initially toward the nozzle axis A and, subsequently, again away from the nozzle axis A.

Instead of a curved configuration of the annular mixing chamber 26 between the injection points 30, 35 and the outlet openings 40, it is possible, in modification of the exemplary embodiment illustrated here, to also provide a hollow cylindrical embodiment of the annular mixing chamber in this section.

From the foregoing, it can be seen that an atomizer nozzle 10 is provided having a liquid channel 19 to which an annular mixing chamber 26 is fluidically connected downstream of the liquid channel. A liquid F is supplied to the liquid channel 19 via a liquid connection 12. The atomizer nozzle 10 additionally has a gas connection 13 which is connected to a gas line system 28. Pressurized gas L is conducted to an outer injection channel 29 and an inner injection channel 34 via the gas line system. Each of the two injection channels 29, 34 opens into the annular mixing chamber 26 at a respective injection point 30, 35. Relative to a nozzle axis A around which coaxially extends the annular mixing chamber 26, the outer injection point 30 is provided on the radially outer mixing chamber wall, and the inner injection point 35 is provided on the radially inner mixing chamber wall. The inflowing liquid can thus be finely atomized using little pressurized gas L in the annular mixing chamber 26 and be dispensed downstream of the annular mixing chamber 26 via at least one outlet opening 40 in the form of a respective spray jet S.

LIST OF REFERENCE SIGNS

10 Atomizer nozzle
11 Nozzle housing
11*a* Housing part
11*b* Tool contact section
12 Liquid connection
13 Gas connection
14 Connection fitting
15 Nozzle body
19 Liquid channel
19*a* First section of liquid channel
19*b* Swirl-generating section
19*c* End section
20 Swirl generator
21 Swirl body
22 Channel wall of the liquid channel
25 Central part
26 Annular mixing chamber
27 Outside surface of the central part
28 Gas line system
29 Outer injection channel
30 Outer injection point
31 Connecting channel
32 Passage opening

33 Central gas channel
34 Inner injection channel
35 Inner injection point
36 Central channel
37 Mouth of the central channel
40 Outlet opening
41 Tube piece
45 Dividing wall
46 Communication opening
α First angle
β Second angle
A Nozzle axis
E Center plane
F Liquid
FH Flow layer
L Pressurized gas
P1 First outflow direction
P2 Second outflow direction
S Spray jet
U Circumferential direction

The invention claimed is:

1. An atomizer nozzle (10) comprising:

a nozzle body (15), liquid connection (12) for supplying a liquid (F) to a liquid channel (19) of the nozzle body (15) that communicates downstream with an annular mixing chamber (26) of the nozzle body (15) coaxial with a nozzle axis (A);

said liquid channel (19) having a widening end section (19*c*) for directing liquid into said annular mixing chamber (26);

a central liquid directing part (25) supported on the nozzle axis (A) in the end section (19*c*) of the liquid channel (19), said central liquid directing part (25) having an outer flow directing surface that extends in a downstream direction a progressively greater distance from the nozzle axis (A) for forming a widening flow layer (FH) of liquid (F) that is directed obliquely away from the nozzle axis (A) and into the annular mixing chamber (26) adjoining the end section (19*c*) of the liquid channel (19);

at least one gas connection (13) for supplying pressurized gas (L) to a gas line system (28) that comprises at least one outer injection channel (29) and at least one inner injection channel (34);

said outer injection channel (29) opening at an outer injection point (30) at a radially outside location relative to the nozzle axis (A) into the annular mixing chamber (26); and said inner injection channel (34) opening into the annular mixing chamber (26) at an inner injection point (35) at a radially inside location relative to the injection point (30) of the outer injection channel (29), and a central gas channel (33) extending along the nozzle axis (A) radially inwardly of the angular mixing chamber (26), said central gas channel (33) being fluidically connected at one end to the at least one gas connection (13) and to the inner injection channel (34) at the other end such that a part of the supplied pressurized gas (L) flows through the central gas channel (33) to the inner injection channel (34) in a direction opposite the flow direction of the flow layer (FH) of liquid (F) into the annular mixing chamber (26) from the gas connection (13) to at least one communication opening flowing through passage openings (32).

2. The atomizer nozzle of claim 1 in which the outer injection point (30) and the inner injection point (35) are arranged so as to be offset relative to each other in an axial extension direction of the annular mixing chamber (26).

3. The atomizer nozzle of claim 2 in which the outer injection point (30) is arranged in the axial extension direction of the annular mixing chamber (26) upstream relative to the inner injection point (35).

4. The atomizer nozzle of claim 1 in which the inner injection channel (34) and the outer injection channel (29) are configured such that the gas volume flow flowing into the annular mixing chamber (26) via the outer injection channel (29) is greater than the gas volume flow flowing into the annular mixing chamber (26) via the inner injection channel (34).

5. The atomizer nozzle of claim 1 in which the annular mixing chamber (26) is connected downstream to at least one outlet opening (40) from which an atomized spray jet (S) is discharged.

6. The atomizer nozzle of claim 5 in which the annular mixing chamber (26) is curved along and in the direction of the nozzle axis (A) one or more times between the outer and inner injection points (30, 35) of the respective injection chambers (29, 34) and the at least one outlet opening (4).

7. The atomizer nozzle of claim 1 in which the central liquid directing part (25) generates a widening flow layer (PH) that is continuously closed in a circumferential direction (U) around the nozzle axis (A).

8. The atomizer nozzle of claim 1 including a swirl liquid generating part (20) supported on the nozzle axis A upstream of the central liquid directing part (20) for imparting a swirl to the liquid (F) flowing in the liquid channel (19).

9. The atomizer nozzle of claim 8 in which the swirl generator part (20) is arranged in a swirl-generating section (19*b*) of the liquid channel (19) adjoining the end section (19*c*) of the liquid channel (19) upstream thereof.

10. The atomizer nozzle of claim 1 in which the central liquid directing part (25) is an integral part of the nozzle body (15).

* * * * *